United States Patent [19]

Hasegawa et al.

[11] 4,042,471

[45] Aug. 16, 1977

[54] PROCESS FOR ELECTROLYTICALLY COLORING ALUMINUM AND ALUMINUM ALLOYS

[75] Inventors: Mutsuo Hasegawa, Uozu; Kazuo Aikawa, Toyama; Katsuyuki Nagata, Uozu, all of Japan

[73] Assignee: Yoshida Kogyo Kabushiki Kaisha, Tokyo, Japan

[21] Appl. No.: 663,551

[22] Filed: Mar. 3, 1976

[30] Foreign Application Priority Data

Mar. 5, 1976 Japan ..... 51-26065

[51] Int. Cl.[2] ..... C25D 11/22

[52] U.S. Cl. ..... 204/58; 204/35 N; 204/42

[58] Field of Search ..... 204/35 N, 58, 56 R, 204/42, 140, 130; 427/419 A

[56] References Cited

U.S. PATENT DOCUMENTS

| | | | |
|---|---|---|---|
| 3,773,631 | 11/1973 | Immel et al. | 204/58 |
| 3,795,590 | 3/1974 | Patrie | 204/35 N |
| 3,912,602 | 10/1975 | Zweifel et al. | 204/58 |

*Primary Examiner*—G. L. Kaplan

*Attorney, Agent, or Firm*—Hill, Gross, Simpson, Van Santen, Steadman, Chiara & Simpson

[57] ABSTRACT

Aluminum or aluminum alloy is first anodized to form an oxide film thereon. With the pores in this oxide film unsealed, the basis metal is then electrolyzed in an electrolytic solution containing at least two metallic salts and a strongly reducing compound, by use of alternating current at potentials not more than about 15 volts.

2 Claims, No Drawings

PROCESS FOR ELECTROLYTICALLY COLORING ALUMINUM AND ALUMINUM ALLOYS

BACKGROUND OF THE INVENTION a. Field of the Invention

This invention relates to a process for electrolytically coloring aluminum or any of its various alloys.

b. Prior Art

For electrolytic coloring of aluminum or aluminum alloys, there has been suggested and practiced extensively a process wherein workpieces are first anodized to form oxide films thereon and then electrolyzed in an electrolytic solution containing a metallic salt such as nickel salt by use of alternating or direct current. The workpieces are colored by deposition of the metal or metal oxide in the pores of the oxide films thereon.

Such a prior art process is generally poor in throwing power, so that particularly in the case of an irregularly shaped workpiece, its protuberant and recessed portions tend to be tinted noticeably differently. Furthermore, since a darker shade is usually produced on the end faces of workpieces, the counter electrode requires intricate masking.

It has also been proposed to make suitably combined use, in the electrolyzing operation of the above described prior art process, of alternating and direct currents or of other currents similar to or quite dissimilar from such currents in waveform. This practice has drawbacks in connection with the complexity of equipment required and its control.

SUMMARY OF THE INVENTION

It is therefore an object of this invention to provide an improved electrolytic process for uniformly coloring aluminum and aluminum alloys.

Another object of the invention is to provide a process of the character described such that aluminum or aluminum alloy can be colored speedily to a desired degree.

According to the process of this invention, briefly summarized, aluminum or aluminum alloy is first anodized to form an oxide film thereon. The anodized basis metal is then electrolyzed in an electrolytic solution containing at least two metallic salts and a strong reducing compound by use of alternating current at a potential up to about 15 volts.

The above and other objects, features and advantages of this invention will become more apparent and understandable from the following detailed description, examples and claims.

DETAILED DESCRIPTION OF THE INVENTION

Aluminum and aluminum alloys to be colored by the process of this invention comprise pure aluminum and the alloys of pure aluminum and at least one of such elements as silicon, magnesium, copper, nickel, zinc, chromium, lead, bismuth, iron, titanium, and manganese.

For anodic treatment of aluminum or any of such aluminum alloys, a desired basis metal may first be degreased, rinsed and otherwise suitably pretreated in the conventional manner. The pretreated basis metal is made anodic in the usual acid electrolytic solution containing sulfuric acid, oxalic acid, sulfamic acid or the like, and electric current is passed through the solution between the anodic basis metal and a cathode also immersed therein as the counter electrode.

In accordance with this invention, the anodized workpiece of aluminum or aluminum alloy is electrolyzed in an electrolytic solution containing at least two metallic salts and a strong reducing compound, by use of alternating current at voltages up to about 15 volts. The metallic salts can be selected, for example, from such inorganic acid salts as nitrates, sulfates, phosphates, hydrochlorides and chromates, and such organic acid salts as oxalates, acetates and tartrates, of various metals typically comprising nickel, cobalt, chromium, copper, magnesium, iron, cadmium, titanium, manganese, molybdenum, calcium, vanadium, tin, lead and zinc. The concentration of the total amount of any two or more selected metallic salts in the electrolytic solution should be in the range of from about 5 to 500 grams per liter and, for the best results, from about 10 to 250 grams per liter.

The desired basis metal can be electrolytically coated in a color which is determined by the combination of any two or more selected metallic salts and by their concentrations in the electrolytic solution. The use of such metallic salts alone, however, would result in relatively low progress of coloring operation in the proposed low voltage process according to the invention, and the throwing power would also be insufficient. The process would therefore be still unsatisfactory particularly when applied to irregularly shaped articles.

The inventive process is totally free from such drawbacks, due to the addition of a strong reducing compound to the electrolytic solution as taught by this invention. The strong reducing compound may be selected, for example, from such dithionites as sodium dithionite (hydrosulfites) and zinc dithionite, such thiosulfates as ammonium thiosulfate, sodium thiosulfate, potassium thiosulfate and iron thiosulfate, thioglycolic acid, and such thioglycollates as ammonium thioglycollate and sodium thioglycollate. The concentration of any selected reducing compound in the electrolytic solution should be in the range of from about 0.05 to 10 grams per liter and, for the best results, from about 0.2 to 3 grams per liter.

Usually, there is further added to the electrolytic solution according to the invention at least one of such inorganic acids as sulfuric acid, nitric acid, hydrochloric acid, phosphoric acid, boric acid, thiocyanic acid and chromic acid; such organic acids as oxalic acid, acetic acid, propionic acid, formic acid, tartaric acid and malic acid; and their ammonium salts, amino salts and imino salts. The concentration of any selected addition agent should range from about 5 to 250 grams per liter.

For electrolytically coloring aluminum or aluminum alloy in accordance with this invention, the anodized basis metal together with a counter electrode is immersed in a bath which has been prepared as above described, and alternating current is passed through the bath at a potential not more than about 15 volts, desirably from about 5 to 14 volts, and most desirably from about 10 to 12.5 volts.

For the best results, the temperature of the bath should be suitably elevated, preferably to a range of from about 40° to 50° C. Favorable results are also obtainable in a bath temperature range of 15° to 25° C. In practice the bath temperature should be suitably determined in consideration of such factors as the composition of the bath, its stability, the progress of sealing due to the temperature rise of the bath, and the drying of the workpieces at the time of the subsequent color matching operation.

It is for the following reasons that voltages of up to about 15 volts are used in the process of this invention. Should the alternating current potential exceed about 15 volts, the uniformity of coatings produced would materially deteriorate, although the coloring of the basis metal would proceed at higher speed due to the addition of some selected strong reducing compound to the bath.

Thus, according to the invention, the desired basis metal can be colored uniformly and speedily by subjecting it to electrolysis in a bath containing at least two metallic salts and a strong reducing compound, by use of alternating current at not more than about 15 volts. Still more improved results are obtainable by suitably elevating the bath temperature, as previously mentioned. The process of this invention is therefore advantageous by reason of higher production, ease of control and, particularly in the case of irregularly shaped articles, uniformity of coloring.

The pores in the films which have been colored by the process of the invention may be sealed by boiling water, by chemicals, or by live steam, as has been known heretofore. After, or without, the sealing treatment, the colored surfaces may be protectively coated with a suitable resin paint as by the dipping or electrodeposition method.

The inventive process is hereinafter described more specifically in terms of several Inventive Examples, which, however, are meant purely to illustrate or explain and not to impose limitations on the invention. Also given hereinbelow are some Comparative Examples which are intended to make clear the advantages of the inventive process over the prior art.

INVENTIVE EXAMPLE I

For anodic treatment, a specimen consisting of an aluminum extrusion sized 150 millimeters by 70 by 1.3 was degreased, etched and desmutted in the usual manner. The thus pretreated specimen was made anodic in an aqueous solution of 17.5 W/V % sulfuric acid, and a DC voltage of 15 volts was impressed for 35 minutes across the anodic specimen and an aluminum cathode connected as the counter electrode in the bath. The current density was 1.2 amperes per square decimeter. The anodic oxide film with a thickness of about 12 microns was thus formed on the specimen, which was then rinsed.

The electrolytic coloring of the above anodized specimen was conducted in a vessel with a length of 300 millimeters, a width of 100 millimeters and a height of 150 millimeters, in which was filled an electrolytic solution of the following composition:

| | | |
|---|---|---|
| Nickel sulfate (hexahydrate) | 25 | g/l |
| Magnesium sulfate (heptahydrate) | 10 | g/l |
| Ammonium thiosulfate | 1 | g/l |
| Ammonium sulfate | 30 | g/l |
| DL-malic acid | 0.5 | g/l |
| Boric acid | 10 | g/l |

The pH of the above electrolytic solution was 5.6, and its temperature was 20° C.

The anodized specimen was immersed in the solution, and a single counter electrode was positioned at a distance of 250 millimeters from the specimen. The specimen was then subjected to electrolysis for three minutes by use of alternating current at a potential of 12.5 volts. The surfaces of the specimen were uniformly colored bronze regardless of their positions with respect to the counter electrode.

The resulting colored film on the specimen was then subjected to sealing treatment for 30 minutes by live steam, under pressure of five kilograms per square centimeter. A 3000-hour accelerated weathering test of the finished specimen by means of a weatherometer developed no change in its colored surfaces. Also, no change in color took place when the specimen was heated to a temperature of 200° C for two hours, and the specimen remained intact when subjected to a 16-hour CASS (copper-accelerated acetic acid salt spray) test. It has thus been confirmed that aluminum or aluminum alloy colored by the process of this invention will sufficiently withstand outdoor use.

INVENTIVE EXAMPLE II

An aluminum extrusion sized 150 millimeters by 70 by 1.3 as anodized by use of the procedure described in Inventive Example I to form thereon an oxide film with a thickness of about 12 microns. The anodized specimen was rinsed and then electrolyzed for three minutes by use of alternating current at 12 volts in an electrolytic solution of the following composition:

| | | |
|---|---|---|
| Nickel sulfate (hexahydrate) | 25 | g/l |
| Magnesium sulfate (heptahydrate) | 10 | g/l |
| Ammonium dithionite | 0.5 | g/l |
| Ammonium sulfate | 30 | g/l |
| Boric acid | 10 | g/l |
| Ferrous sulfate (heptahydrate) | 15 | g/l |

The pH of this electrolytic solution was 5.6, and its temperature was 20° C. The specimen was uniformly colored greenish bronze.

The pores in the thus obtained colored film were then sealed in the manner set forth in Inventive Example I. The finished specimen exhibited the same favorable results as that of the preceding Example when subjected to a 3000-hour accelerated weathering test by means of a weatherometer, a 2-hour heating test at a temperature of 200° C, and a CASS test.

INVENTIVE EXAMPLE III

An aluminum extrusion sized 150 millimeters by 70 by 1.3 was anodized by use of the procedure of Inventive Example I to form thereon an oxide film about 12 microns thick. The anodized specimen was rinsed and then electrolyzed for five minutes by use of alternating current at a potential of 10 volts in an electrolytic solution of the following composition:

| | | |
|---|---|---|
| Nickel sulfate (hexahydrate) | 30 | g/l |
| Magnesium sulfate (heptahydrate) | 15 | g/l |
| Copper sulfate (pentahydrate) | 7 | g/l |
| Ammonium thiosulfate | 1 | g/l |
| Ammonium sulfate | 30 | g/l |
| Boric acid | 15 | g/l |

The pH of the above electrolytic solution was 5.6, and its temperature was 20° C. The specimen was uniformly colored deep maroon.

The pores in the thus obtained colored film on the specimen were sealed in the same manner as in Inventive Example I. The finished specimen exhibited the same favorable results as that of Inventive Example I when subjected to a 3000-hour accelerated weathering test by means of a weatherometer, a 2-hour heating test at a temperature of 200° C, and a CASS test.

COMPARATIVE EXAMPLE I

An aluminum extrusion sized 150 millimeters by 70 by 1.3 was anodized by use of the procedure of Inventive Example I to form thereon an oxide film about 12 microns thick. The anodized specimen was rinsed and then electrolyzed for nine minutes by use of alternating current at a potential of 12 volts in an electrolytic solution of the following composition:

| | | |
|---|---|---|
| Nickel sulfate (hexahydrate) | 25 | g/l |
| Magnesium sulfate (heptahydrate) | 20 | g/l |
| Boric acid | 25 | g/l |
| Ammonium sulfate | 30 | g/l |

The pH of the above electrolytic solution was 5.6, and its temperature was 20° C.

The specimen was colored bronze. Its surface which had been directed away from the counter electrode, however, had a significantly lighter shade than the other surface which had been facing the counter electrode, the color on the first mentioned surface becoming still lighter toward its center.

INVENTIVE EXAMPLE IV

To the electrolytic solution of Comparative Example I was added, in accordance with the teaching of this invention, 0.5 gram per liter of sodium dithionite to prepare a solution of the following composition:

| | | |
|---|---|---|
| Nickel sulfate (hexahydrate) | 25 | g/l |
| Magnesium sulfate (heptahydrate) | 20 | g/l |
| Boric acid | 25 | g/l |
| Ammonium sulfate | 30 | g/l |
| Sodium dithionite | 0.5 | g/l |

The pH of this electrolytic solution was also 5.6, and its temperature was also 20° C.

An aluminum extrusion sized 150 millimeters by 70 by 1.3 was anodized and rinsed by use of the procedure described in Inventive Example I and was then electrolyzed for three minutes in the solution of the above composition by use of alternating current at a potential of 12 volts. The specimen was uniformly colored bronze on both of its surfaces, to the same coloring degree as the darker colored surface of the specimen of Comparative Example I which had been electrolyzed for nine minutes.

COMPARATIVE EXAMPLE II

An aluminum extrusion sized 150 millimeters by 70 by 1.3 was anodized by use of the procedure set forth in Inventive Example I to form thereon an oxide film about 12 microns thick. The specimen was rinsed and then electrolyzed for eight minutes by use of alternating current at a potential of 12.5 volts in an electrolytic solution of the following composition:

| | | |
|---|---|---|
| Nickel sulfate (hexahydrate) | 30 | g/l |
| Boric acid | 25 | g/l |
| Ammonium sulfate | 30 | g/l |

The pH of the above electrolytic solution was 4.5, and its temperature was 40° C.

The specimen was colored generally light bronze. Its surface which had been directed away from the counter electrode had a lighter shade than the other surface which had been confronting the counter electrode, and the color on the first mentioned surface became still lighter toward its center.

COMPARATIVE EXAMPLE III

To the electrolytic solution of Comparative Example II was added 1.0 gram per liter of ammonium thiosulfate to form a solution of the following composition:

| | | |
|---|---|---|
| Nickel sulfate (hexahydrate) | 30 | g/l |
| Boric acid | 25 | g/l |
| Ammonium sulfate | 30 | g/l |
| Ammonium thiosulfate | 1 | g/l |

The pH of this electrolytic solution was also 4.5, and its temperature was also 40° C.

An aluminum extrusion of the same size as described above was anodized and rinsed by use of the procedure described in Inventive Example I and was then electrolyzed for eight minutes in the solution of the above composition by use of alternating current at a potential of 12.5 volts. The results were just as unsatisfactory as those set forth in Comparative Example II, in spite of the addition of ammonium thiosulfate to the bath.

INVENTIVE EXAMPLE V

To the electrolytic solution of Comparative Example III was further added, in accordance with the teaching of this invention, 20 grams per liter of magnesium sulfate to prepare a solution of the following composition:

| | | |
|---|---|---|
| Nickel sulfate (hexahydrate) | 30 | g/l |
| Boric acid | 25 | g/l |
| Ammonium sulfate | 30 | g/l |
| Ammonium thiosulfate | 1 | g/l |
| Magnesium sulfate (heptahydrate) | 20 | g/l |

The pH of this electrolytic solution was also 4.5, and its temperature was also 40° C.

An aluminum extrusion of the same size as described above was anodized and rinsed by use of the procedure described in Comparative Example II and was then electrolyzed for three minutes in the solution of the above composition by use of alternating current at a potential of 12.5 volts. The specimen was uniformly colored in bronze on both of its surfaces, to the same degree as the darker colored surface of the specimen of Comparative Example II which had been electrolyzed for eight minutes.

INVENTIVE EXAMPLE VI

The procedure of Inventive Example I was faithfully repeated except that the anodized aluminum extrusion was electrolyzed for three minutes by use of alternating current at a potential of 12 volts in a solution of the following composition, which had a pH of 5:

| | | |
|---|---|---|
| Nickel sulfate (hexahydrate) | 25 | g/l |
| Magnesium sulfate (heptahydrate) | 20 | g/l |
| Ammonium thioglycollate | 1.5 | g/l |
| Ammonium sulfate | 30 | g/l |
| Boric acid | 20 | g/l |

The results were the same as those set forth in Inventive Example III.

What is claimed is:

1. A process for electrolytically coloring aluminum or an aluminum alloy which comprises electrolyzing anodized aluminum or an aluminum alloy in an acidic, aqueous electrolyte containing at least two coloring metallic salts in the range of from about 5 to 500 grams per liter and a strong reducing compound selected from the group consisting of dithionites, thiosulfates, thioglycolic acid, and thioglycolates in the range of from about 0.05 to 10 grams per liter at an alternating current potential of up to 15 volts.

2. The process as recited in claim 6, wherein said metallic salts are selected from the group consisting of inorganic and organic acid salts of nickel, cobalt, chrominum copper, magnesium, iron, cadmium, titanium, manganese, molybdenum, calcium, vanadium, tin, lead, and zinc.

* * * * *